US010202770B2

(12) United States Patent
Rapperstorfer

(10) Patent No.: US 10,202,770 B2
(45) Date of Patent: Feb. 12, 2019

(54) REINFORCING ELEMENT AND METHOD FOR PRODUCING A REINFORCING ELEMENT

(71) Applicant: Hubert Rapperstorfer, Steinhaus bei Wels (AT)

(72) Inventor: Hubert Rapperstorfer, Steinhaus bei Wels (AT)

( * ) Notice: Subject to any disclaimer, the term of this patent is extended or adjusted under 35 U.S.C. 154(b) by 0 days.

(21) Appl. No.: 15/502,629

(22) PCT Filed: Aug. 11, 2015

(86) PCT No.: PCT/AT2015/050198

§ 371 (c)(1),
(2) Date: May 22, 2017

(87) PCT Pub. No.: WO2016/023058

PCT Pub. Date: Feb. 18, 2016

(65) Prior Publication Data

US 2017/0254084 A1 Sep. 7, 2017

(30) Foreign Application Priority Data

Aug. 12, 2014 (AT) ..... 50565/2014

(51) Int. Cl.

| | |
|---|---|
| ***E04C 5/06*** | (2006.01) |
| ***E04C 5/16*** | (2006.01) |
| ***E04C 5/18*** | (2006.01) |
| ***E04C 2/04*** | (2006.01) |

(Continued)

(52) U.S. Cl.

CPC ..... *E04C 5/064* (2013.01); *B28B 7/085* (2013.01); *B28B 23/028* (2013.01); *E04B 2/84* (2013.01);

(Continued)

(58) Field of Classification Search

CPC . E04C 5/064; E04C 5/168; E04C 5/18; E04C 2/044; E04C 2002/047;

(Continued)

(56) References Cited

U.S. PATENT DOCUMENTS 3,879,908 A * 4/1975 Weismann ..... B21F 27/128 52/309.12

4,104,842 A 8/1978 Rockstead et al.

(Continued)

FOREIGN PATENT DOCUMENTS

AU 2004244664 B2 12/2004
DE 2 337 714 A1 2/1975

(Continued)

OTHER PUBLICATIONS

International Search Report of PCT/AT2015/050198, dated Nov. 25, 2015.

*Primary Examiner* — Theodore V Adamos
(74) *Attorney, Agent, or Firm* — Collard & Roe, P.C.

(57) ABSTRACT

A reinforcing element includes a first and a second reinforcing mat having metal mat rods, which are welded at angles to each other at junction points, which reinforcing mats are held spaced apart from each other at a normal distance by rod-shaped spacers with respect to the first mat plane and the second mat plane of the reinforcing mats. The spacers are metal and are permanently connected to individual mat rods of the first and second reinforcing mat by welding connections, preferably resistance welding connections, wherein at least individual spacers protrude outward at least beyond the first mat plane of the first reinforcing mat in a direction pointing away from the second reinforcing mat by a first protrusion length. Further, a double wall is furnished with the reinforcing element and a method produces the reinforcing element and the double wall.

7 Claims, 8 Drawing Sheets

Figure 1:
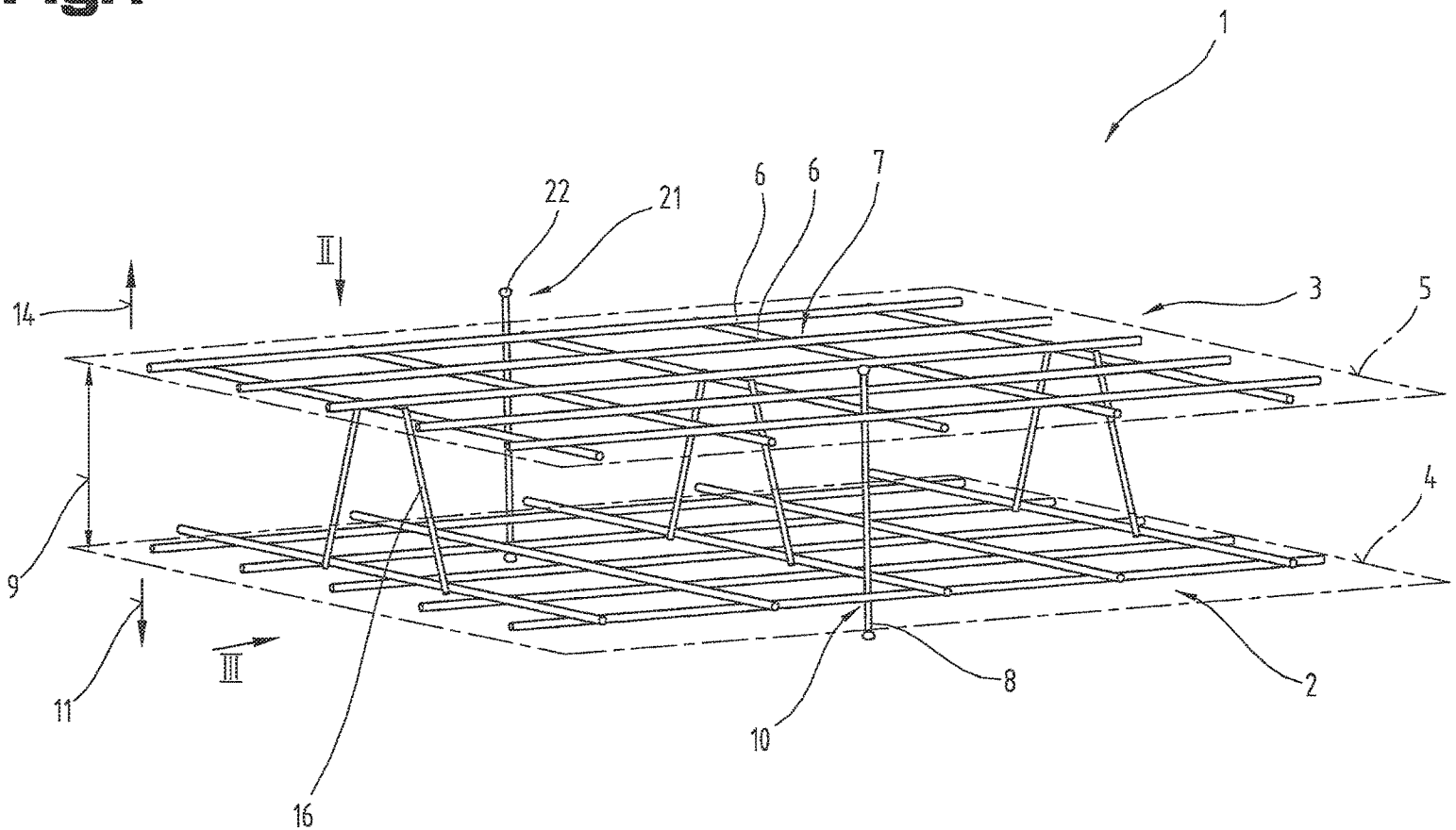

(51) Int. Cl.

| | |
|---|---|
| ***E04B 2/86*** | (2006.01) |
| ***E04B 2/84*** | (2006.01) |
| ***B28B 7/08*** | (2006.01) |
| ***B28B 23/02*** | (2006.01) |

(52) U.S. Cl.
CPC ..... *E04B 2/8617* (2013.01); *E04C 2/044* (2013.01); *E04C 5/168* (2013.01); *E04C 5/18* (2013.01); *E04B 2103/02* (2013.01); *E04B 2103/06* (2013.01); *E04C 2002/047* (2013.01); *E04C 2002/048* (2013.01)

(58) Field of Classification Search
CPC .. E04C 2002/048; E04B 2/84; E04B 2103/02; E04B 2103/06; E04B 2/8617; B28B 7/085; B28B 23/028
USPC ..... 52/648.1, 649.1, 649.6, 650.2, 660
See application file for complete search history.

(56) References Cited

U.S. PATENT DOCUMENTS

| | | | | |
|---|---|---|---|---|
| 5,146,721 | A * | 9/1992 | Candiracci | E04L 32/845 181/284 |
| 5,398,470 | A * | 3/1995 | Ritter | E04L 35/38 52/309.11 |
| 6,185,890 | B1 * | 2/2001 | Ritter | E04C 2/044 52/251 |
| 6,691,486 | B1 * | 2/2004 | Durand | E04B 2/8647 52/645 |
| 6,718,712 | B1 * | 4/2004 | Heath | E04C 2/044 52/309.12 |
| 2003/0192272 | A1 * | 10/2003 | Bravinski | E04B 2/8635 52/309.11 |
| 2009/0113829 | A1 * | 5/2009 | Meier | E04C 2/044 52/405.3 |
| 2010/0024346 | A1 * | 2/2010 | Strahin | E04C 5/20 52/699 |
| 2015/0075110 | A1 * | 3/2015 | Golledge | E04C 5/167 52/688 |

FOREIGN PATENT DOCUMENTS

| | | | |
|---|---|---|---|
| DE | 2 341 901 | A1 | 3/1975 |
| DE | 3 122 940 | A1 | 12/1982 |
| DE | 3 408 878 | A1 | 3/1985 |
| DE | 20 2007 004 408 | U1 | 6/2007 |
| GB | 2 196 660 | A | 5/1988 |
| WO | 2004/108321 | A1 | 12/2004 |
| WO | 2014/045244 | A2 | 3/2014 |

* cited by examiner

REINFORCING ELEMENT AND METHOD FOR PRODUCING A REINFORCING ELEMENT

CROSS REFERENCE TO RELATED APPLICATIONS

This application is the National Stage of PCT/AT2015/050198 filed on Aug. 11, 2015, which claims priority under 35 U.S.C. § 119 of Austrian Application No. A 50565/2014 filed on Aug. 12, 2014, the disclosure of which is incorporated by reference. The international application under PCT article 21(2) was not published in English.

The invention relates to a reinforcing element and a double wall equipped with a reinforcing element and a method for producing a part.

Generic reinforcing elements usually exhibit a two-dimensional base element and intermediate elements for providing a three-dimensional structure. The intermediate elements are usually designed in the form of a lattice girder, where additional rod elements protrude from the two-dimensional base element and where the additional rod elements are connected by longitudinal rods on the side facing away from the base element.

Designs known from the prior art have the disadvantage that the reinforcing element is time-consuming to set up and that at least one shell of a double wall furnished with the reinforcing element is at risk of rupturing.

The aim of the present invention is to create a reinforcing element that is stable and whose production is easy to automate and to disclose a method for producing such a part.

This aim is achieved by the measures in accordance with the invention.

In the invention, there is a reinforcing element comprising a first and a second reinforcing mat with metal mat rods welded at angles to each other at junction points. The reinforcing mats are held spaced apart from each other at a normal distance by rod-shaped spacers with respect to the first and second mat plane. The spacers are metal and are permanently connected to individual mat rods of the first and second reinforcing mat by welding connections, preferably resistance welding connections, wherein at least individual spacers protrude outward at least beyond the first mat plane of the first reinforcing mat in a direction pointing away from the second reinforcing mat by a first protrusion length.

An advantage of the invented design is that welding the two reinforcing mats to each other using the spacers makes it possible to form a stable three-dimensional reinforcing element. This reinforcing element is easily moved by a crane or other lifting device and can thus be transported in an automated or partially automated assembly line and can be manufactured at any location to keep the throughput time in an assembly line as short as possible. Because the spacers protrude outward from the first mat plane of the first reinforcing mat by a first protrusion length, the stable three-dimensional reinforcing element can be placed on a plane surface such that the first reinforcing mat can be arranged at a predefined distance equivalent to the first protrusion length away from this plane surface. Thus the first reinforcing mat can be inserted into a part at a desired place without having to provide additional means of support. Another advantage of the invented reinforcing element is that it can be produced using very few parts and is therefore very lightweight as well as simple and affordable to manufacture.

It can further be expedient for the spacers to also protrude outward beyond the second mat plane of the second reinforcing mat in a direction pointing away from the first reinforcing mat by a second protrusion length. The advantage here is not only that the first reinforcing mat can be held at a defined distance from a level contact surface, but also that if the reinforcing element is turned, the second reinforcing mat can be held at a defined distance from a level contact surface to better reinforce a concrete part.

It can further be provided that the first and second protrusion lengths be equal in size and measure between 5 mm and 100 mm, especially between 10 mm and 50 mm, preferably between 15 mm and 30 mm. The advantage here is that if the invented reinforcing element is used to create a double wall the two wall shells can be designed symmetrically or identically. In particular, the protrusion length in the stated range makes it possible for a minimum concrete covering required by standards or for structural reasons with respect to the first and/or second reinforcing mat to be reached.

It can further be provided that the spacers be oriented normal to the mat planes. The advantage here is that the spacers can be positioned between the reinforcing mats quickly and easily during the manufacturing process. Furthermore, the first reinforcing mat and the second reinforcing mat can be positioned easily in respect to each other.

Also advantageous is a form in which protective caps are arranged in at least one end section of at least individual spacers. During the manufacturing process of a double wall, the protective caps will act as protection for the surface of a formwork pallet on which the reinforcing element lies. After the double wall is completed, the protective caps act as corrosion protection for the spacers equipped with the protective caps. Without the protective caps, the spacers would be in contact with oxidation-causing air at the surface.

In a further development, it is possible for the protective caps to be made of a plastic material, especially to be an injection moulded part, and to have a receiving hole whose diameter is equal to or slightly smaller than the diameter of the spacers near the protrusion length. Protective caps of a plastic material in particular have good corrosion resistance and can be quickly and easily manufactured in serial production. Injection moulded parts are particularly suited for manufacturing in serial production, with the shape being freely chosen for injection moulded parts. If the receiving hole of the protective caps is slightly smaller than or equal to the diameter of the spacers, the protective caps can be easily fitted onto the spacers so that they do not fall off accidentally during the manufacturing process.

It can further be expedient for the protective caps to be configured to be tapering and/or rounded in an end section facing away from the receiving hole. The advantage here is that the protective caps then have a contact surface or support end that can lie against a shell element. Another benefit of the tapering is that in the completed part, such as a double wall, the support end of the protective cap visible on the surface is as small as possible or as little of the protective cap and the surface is visible as possible.

It can further be provided that tie rods running at an angle to the spacers are welded to the mat rods of the first and second reinforcing mat. An advantage of the additional tie rods is that possible parallel displacement of the first and second reinforcing mats relative to each other can be prevented or a large resistance can be put up against such a parallel displacement.

It can further be provided that the spacers and/or tie rods be connected to the junction points of the mat rods at a distance from these. It is advantageous here for the spacers and/or tie rods, especially at their connection points with the mat rods, to be easily accessible so that they can, for example, be welded by an industrial robot. Then an industrial robot for manufacturing the invented reinforcing element can be designed as simply as possible.

In a special form, it is also possible for contact rods placed parallel to the reinforcing mats to be welded to the spacers and/or tie rods in the area of the second reinforcing mat and to form a support plane for the second reinforcing mat. The advantage here is that it makes positioning the second reinforcing mat in the manufacturing process for manufacturing the reinforcing element quick and easy. In this way the second reinforcing mat can be positioned as precisely as possible relative to the first reinforcing mat.

In an advantageous further development, it can be provided that at least one lifting frame be placed between the first and second reinforcing mat and welded to both of them. An advantage here is that the lifting frame can be placed at the centre of gravity between the two reinforcing mats to make manipulating the reinforcing element easier. The lifting frame can further contribute to additional stabilisation of the reinforcing element. Another advantage of a lifting frame welded to the reinforcing mats is that it is attached to the reinforcing element or double wall with greater strength. This reduces the likelihood of the reinforcing element or a double wall furnished with the reinforcing element separating from the lifting frame during the lifting process and becoming a source of danger to people.

It can further be expedient if the mat rods of the first and second reinforcing mats are arranged congruent with each other in the normal direction on the mat planes. The advantage here is that the cut of the two reinforcing mats can be identical or congruent, making it easy to automate the manufacturing of the reinforcing mats. Another advantage of this design is that spacers that are arranged in the normal direction on the individual reinforcing mats in particular can be easily positioned on and welded to the reinforcing rods.

It can further be provided that the reinforcing element have a formwork element in the form of a sheet that extends between the two reinforcing mats and is attached, especially welded, to the two reinforcing mats. A formwork element could be, for example, a metal strip. The purpose of the formwork elements is to keep the concrete used as filling or for pouring inside the cavity provided for the filling at the construction site in the end manufacturing of the double wall. In a first embodiment, the formwork elements can be used as an external stop end of the double wall. In another embodiment variation, it is conceivable that the formwork elements could be used in window recesses or door recesses to be a stop end for these. In yet another embodiment variation, it can be provided that the formwork elements be placed in the middle of the wall to form a cavity. This way the quantity of concrete needed can be kept as small as possible.

It can further be provided that an electrical outlet place holder be attached, especially welded, to at least one of the reinforcing mats. The electrical outlet place holder can serve as a stop end for an electrical outlet so that an electrical outlet can be inserted into the wall after manufacturing of the double wall.

It can further be provided that empty piping be connected to the electrical outlet place holder, with the empty piping being held by holding clamps, with the holding clamps being attached, especially welded, to one of the reinforcing mats.

It can further be provided that the spacers and/or mat rods be made of reinforcing steel with rolled-in ridges or other surface contours. The advantage here is that using reinforcing steel for the reinforcing element can give the latter increased tensile forces, as concrete attaches well to the reinforcing steel.

The invention also provides for a double wall comprising a first and second wall shell of concrete, into which first and second wall shell a reinforcing element as per the invention is at least partially integrated. The first reinforcing mat of the reinforcing element is integrated into the first wall shell and the second reinforcing mat is integrated into the second wall shell. The advantage of the invented double wall is that the invented reinforcing element that is built in has two reinforcing mats placed at a distance from each other that are integrated into the two wall shells. Using the reinforcing mats increases the reinforcing element's resistance to being torn out of the wall shell compared to a comparable double wall with a lattice girder configuration. This increases safety, as unwanted separation of the wall shell from the reinforcing element can be reduced. This is particularly important on construction sites, as falling concrete during lifting work would constitute a serious safety hazard to workers. Using the invented reinforcing element in a double wall can further make it possible for the filling speed during concrete filling of the double wall to be increased compared to conventional double walls, as the two wall shells are connected to the stable reinforcing element in a better way. In addition, using the invented reinforcing element can minimise the concrete covering of the wall shell, allowing the complete double wall to be manufactured with a reduced weight. This brings with it savings in production. In addition, a reduced weight double wall can be transported in a more affordable and environmentally friendly way, and the handling of the double wall during a lifting process is made easier.

The method for producing a part has the following process steps:

- Provision of a first reinforcing mat with metal mat rods welded at angles to one another in junction points;
- Positioning of rod-shaped spacers across from the mat rods of the first reinforcing mat;
- Welding of the spacers to the mat rods of the first reinforcing mat;
- Positioning of a second reinforcing mat at a normal distance from the first reinforcing mat, with the second reinforcing mat being positioned in such a way that the spacers extend between the first reinforcing mat and the second reinforcing mat;
- Welding of the spacers to the mat rods of the second reinforcing mat to provide a three-dimensional reinforcing element.

An advantage of the invented method for producing a part, especially of the invented reinforcing element, lies in the fact that the rod-shaped spacers can easily be positioned by a manufacturing system, in particular by a robotic system, on the first reinforcing mat and welded to it. The second reinforcing mat can then also be positioned by the manufacturing system, in particular the robotic system, relative to the first reinforcing mat and then welded to the spacers so that a stable, three-dimensional reinforcing element is created. Such a reinforcing element is stable enough that it can be transported in its entirety within a production facility or to external production sites to be used ready-made at whatever location desired. In particular, the reinforcing element can be prefabricated in its own manufacturing segment and then used in its entirety in a manufacturing process for producing a double wall. It can further be provided that the individual process steps be carried out in an order different to this list.

It can further be expedient for the spacers to be positioned compared to the mat rods of the first reinforcing mat such that the spacers protrude beyond the mat rods of the first reinforcing mat by a first protrusion length. Because the spacers protrude outward from the mat rods of the first reinforcing mat by a first protrusion length, the stable three-dimensional reinforcing element can be placed on a plane surface such that the first reinforcing mat can be arranged at a predefined distance equivalent to the first protrusion length away from this plane surface. Thus it is no longer necessary to prepare the formwork pallet with ridges underneath, lattice girders, spacers, etc. as is the case in the production of conventional double walls.

It can further be provided that the second reinforcing mat be positioned such that the spacers protrude beyond the mat rods of the second reinforcing mat by a second protrusion length. The advantage here is that not only the first reinforcing mat can be held at a defined distance from a level contact surface, but also that if the reinforcing element is turned, the second reinforcing mat can be held at a defined distance from a level contact surface to better reinforce a concrete part.

It can further be provided that before the positioning of the rod-shaped spacers these be cut to length and provided with protective caps on at least one end section. The advantage here is that the rod-shaped spacers can be delivered as bar stock after first being cut to length in the manufacturing process. This makes it possible for all spacers to have an individually adjustable length. It is also advantageous if the spacers are already furnished with protective caps after the cutting to length and before installation/welding into the first reinforcing mat, as this work step is easy to combine with a cutting process from a manufacturing point of view.

In a further development, it is possible for tie rods running at an angle to the spacers to be welded to the mat rods. The advantage here is that the tie rods can be welded to the mat rods simply and affordable during the manufacturing process.

It can further be expedient for contact rods running parallel to the first reinforcing mat to be positioned and welded to the spacers and/or tie rods before the positioning of the second reinforcing mat. The advantage here is that the contact rods form support elements on which the second reinforcing mat can be placed during the manufacturing process. This makes it easy for a manufacturing system or an industrial robot to position the end of the second reinforcing mat and weld it to the spacers and/or tie rods. In addition, this largely prevents excessive sagging of the second reinforcing mat during the positioning process relative to the first reinforcing mat.

It can further be provided that the following process steps be performed after preparation of a three-dimensional reinforcing element:

- Provision of a horizontally oriented formwork pallet and optional mounting of limiting formwork on the formwork pallet;
- Positioning of the reinforcing element on the formwork pallet;
- Optional supplementation or mounting of limiting formwork on the formwork pallet;
- Application of a layer of concrete onto the formwork pallet, with vibration of the formwork pallet or concrete layer as necessary until the first reinforcing mat is fully covered;
- Storage of the part until hardening or solidification of the concrete layer into a first wall shell. The advantage here is that for production of a double wall the formwork pallet can be largely prepared and the reinforcing element can be inserted into the formwork pallet in its entirety. Thus it is no longer necessary to prepare the formwork pallet with ridges underneath, lattice girders, spacers, etc. as is the case in the production of conventional double walls. This can considerably increase the quality of the manufacturing process for producing a double wall. On the one hand, process speed can be increased because the reinforcing element can be inserted in its entirety. On the other hand, process precision and repeatability can be increased because the reinforcing element can be executed through preparation as an inherently stable part.

In an alternative variation, it can be provided that the following process steps be performed after preparation of a three-dimensional reinforcing element:

- Provision of a horizontally oriented formwork pallet and mounting of limiting formwork on the formwork pallet;
- Application of a concrete layer onto the formwork pallet;
- Dipping of the first reinforcing mat of the reinforcing element into the concrete layer, with vibration of the formwork pallet and/or reinforcing element as necessary until the first reinforcing mat is fully covered by concrete;
- Storage of the part until hardening or solidification of the concrete layer into a first wall shell. The advantage here is that the manufacturing process can be further accelerated because the concrete layer can already be applied before inlaying the reinforcing element into the formwork pallet. This production method or manufacturing method can only be performed using the invented reinforcing element.

It can further be provided that the following process steps be performed after production of the first wall shell:

- Removal of the reinforcing element with the attached first wall shell from the formwork pallet;
- Turning of the reinforcing element with the attached first wall shell;
- Provision of a horizontally oriented formwork pallet and mounting of limiting formwork on the formwork pallet;
- Application of a concrete layer onto the formwork pallet;
- Dipping of the second reinforcing mat of the reinforcing element into the concrete layer, with vibration of the formwork pallet and/or reinforcing element as necessary until the second reinforcing mat is fully covered by concrete;
- Storage of the part until hardening or solidification of the concrete layer into a second wall shell. The advantage here is that the reinforcing element is already firmly integrated into the first wall shell and this part can be easily moved and positioned in the manufacturing process because of the stable design of the reinforcing element. In addition, the partially finished part can be dipped precisely into the concrete layer of the preparatory formwork pallet by a turning device such that the second wall shell can be produced with exact positioning.

Finally, it can be provided that the part be stored in a hardening chamber until solidification or hardening of the concrete layer to a first and/or second wall shell. The advantage here is that the hardening process of the wall shells can be accelerated. Thus the time until adequate hardening of the wall shells can be shortened so that they can be transported as quickly as possible and the formwork pallet becomes free again.

To facilitate better understanding of the invention, it will be explained in detail using the figures below.

Figure 2:
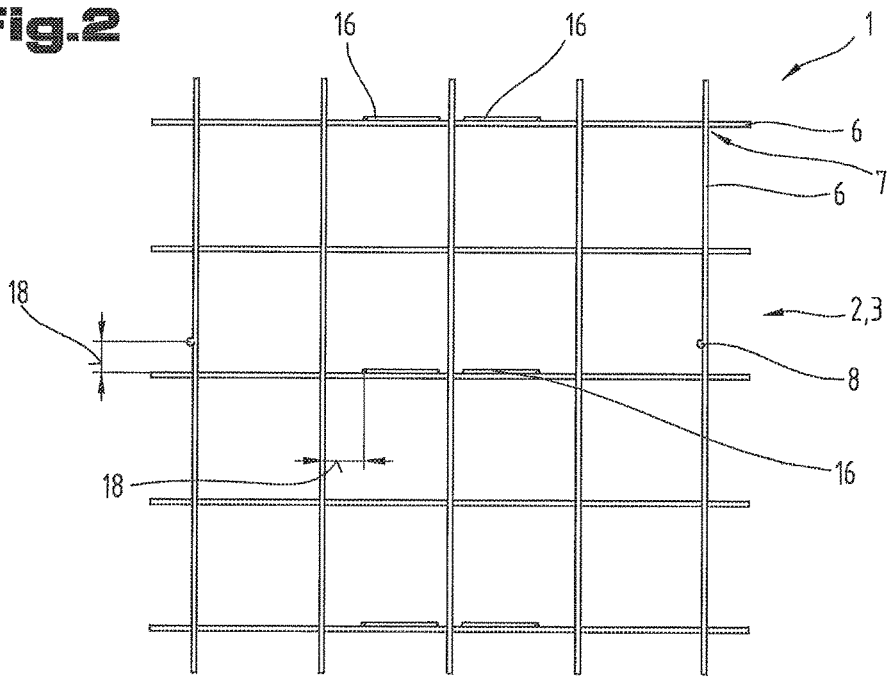
Figure 3:
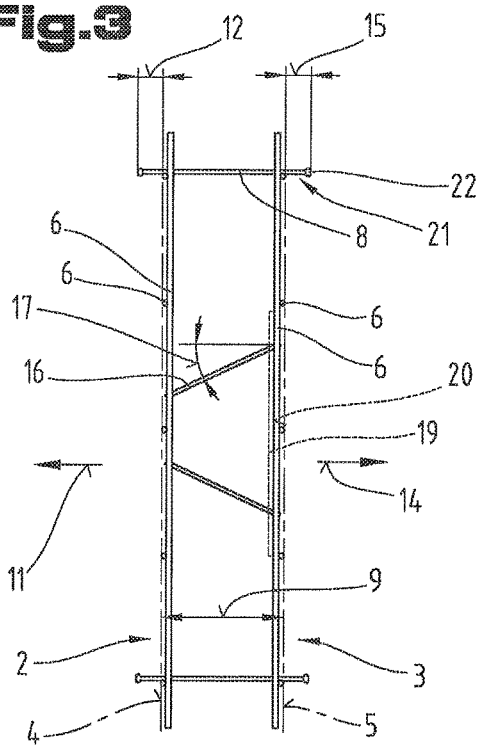
Figure 4:
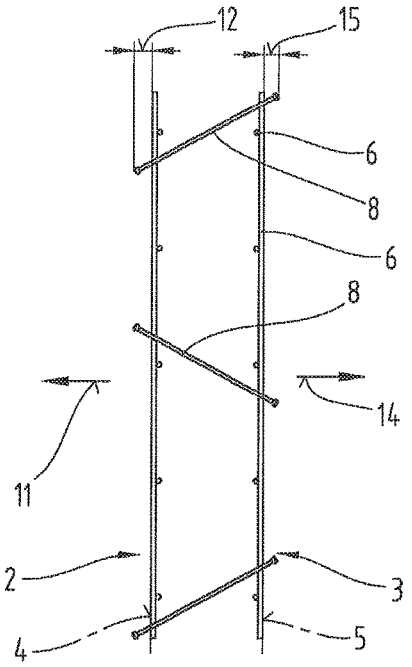
Figure 5:
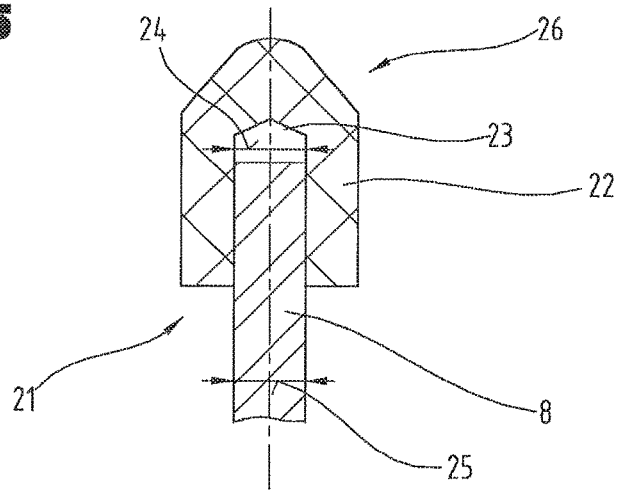
Figure 6:
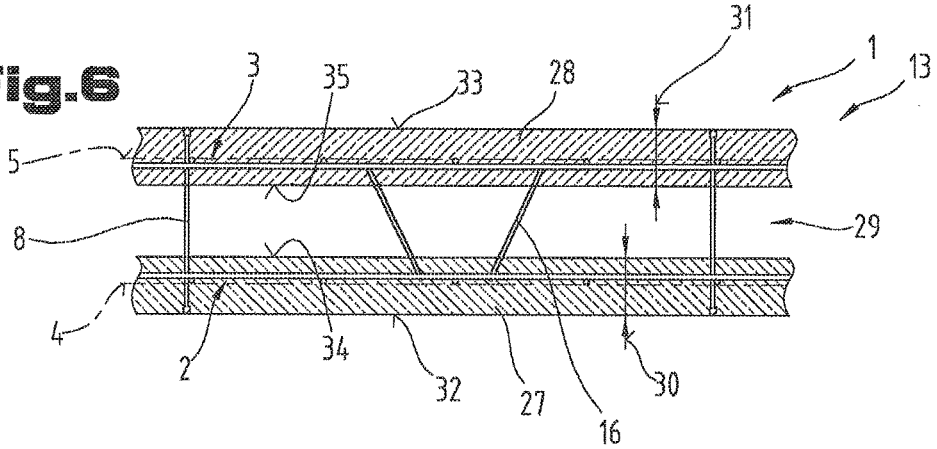
Figure 7:
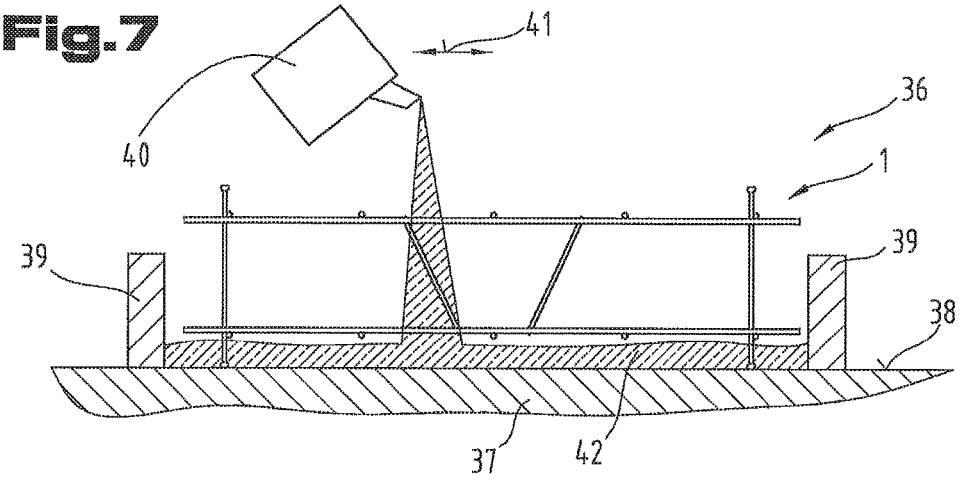
Figure 8:
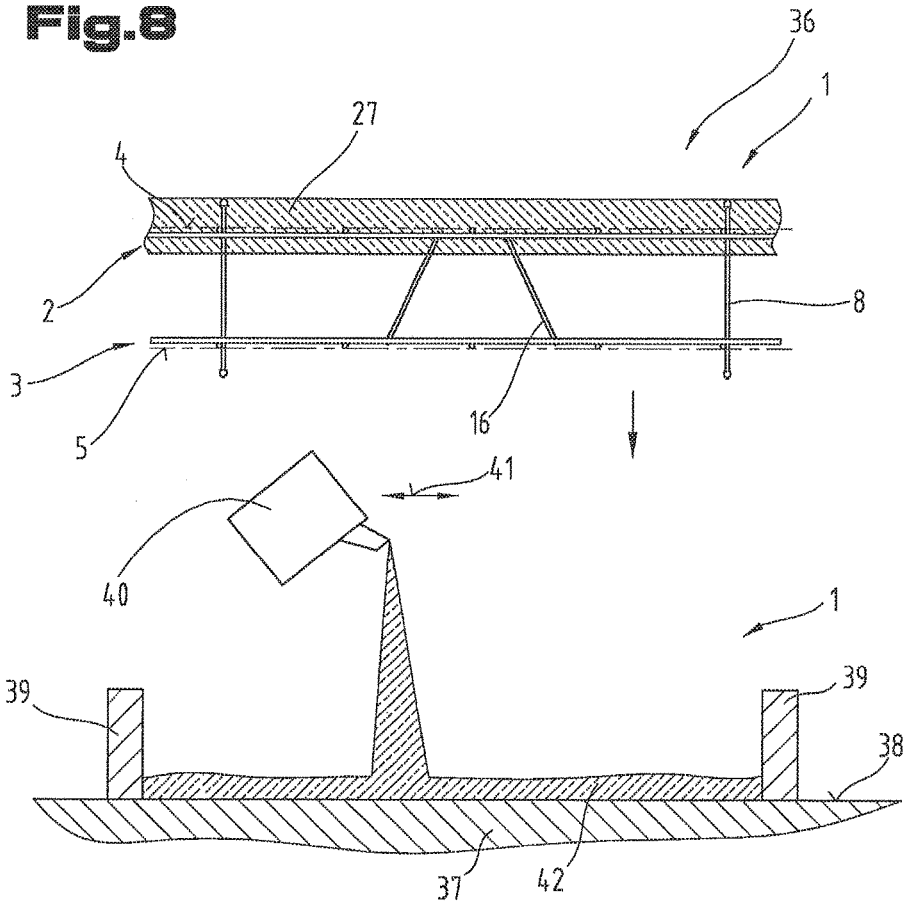
Figure 10:
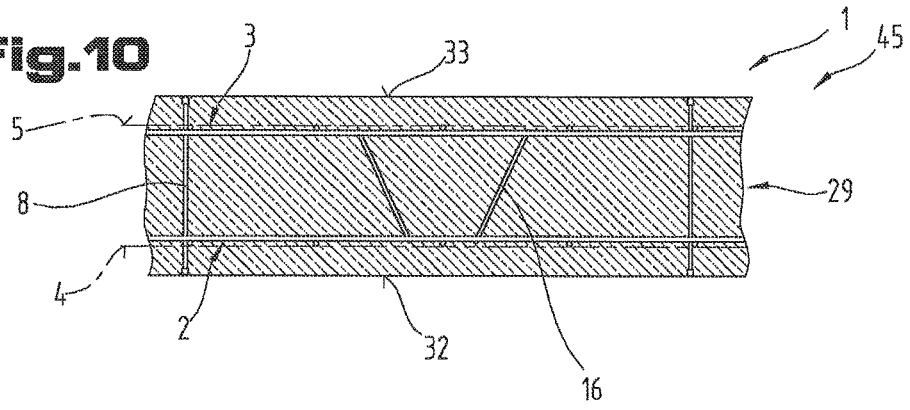
Figure 9:
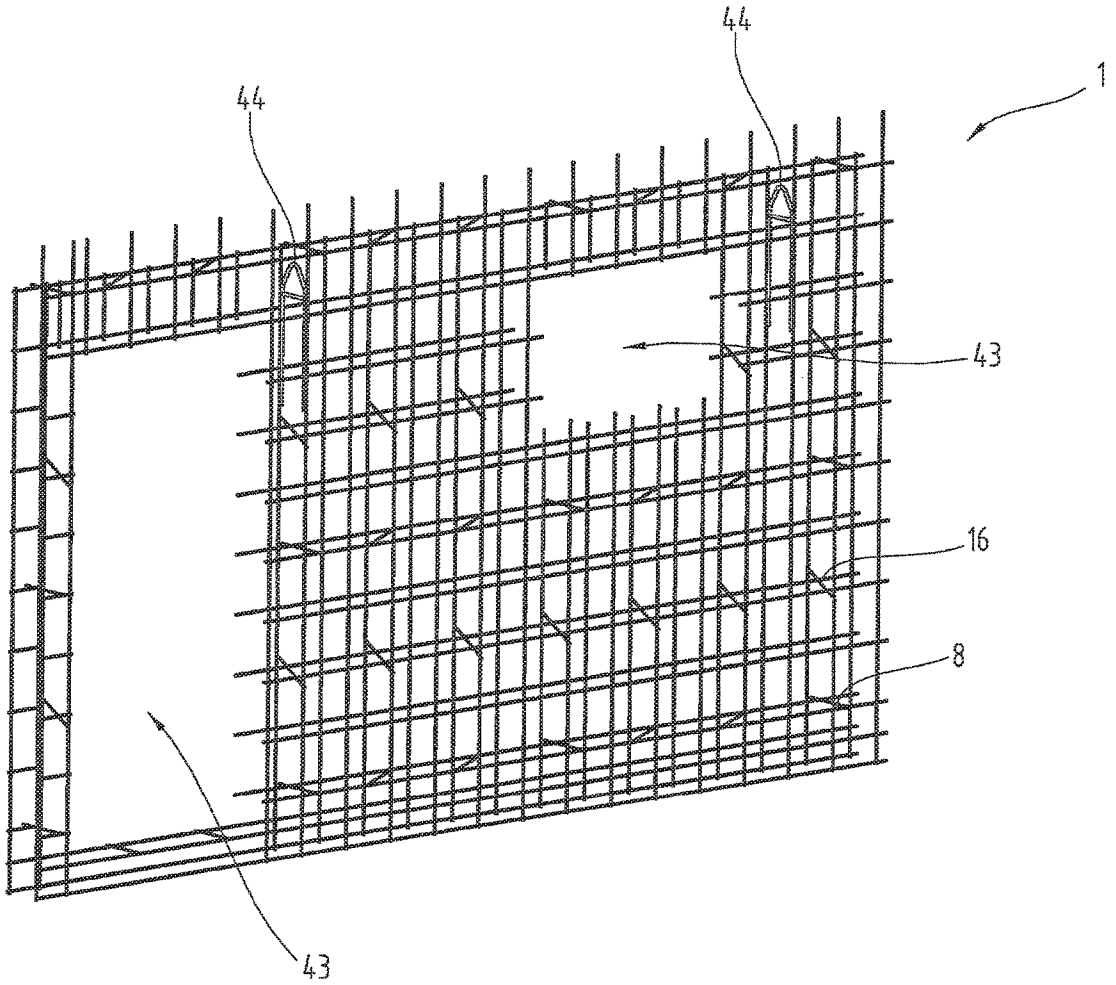
Figure 11:
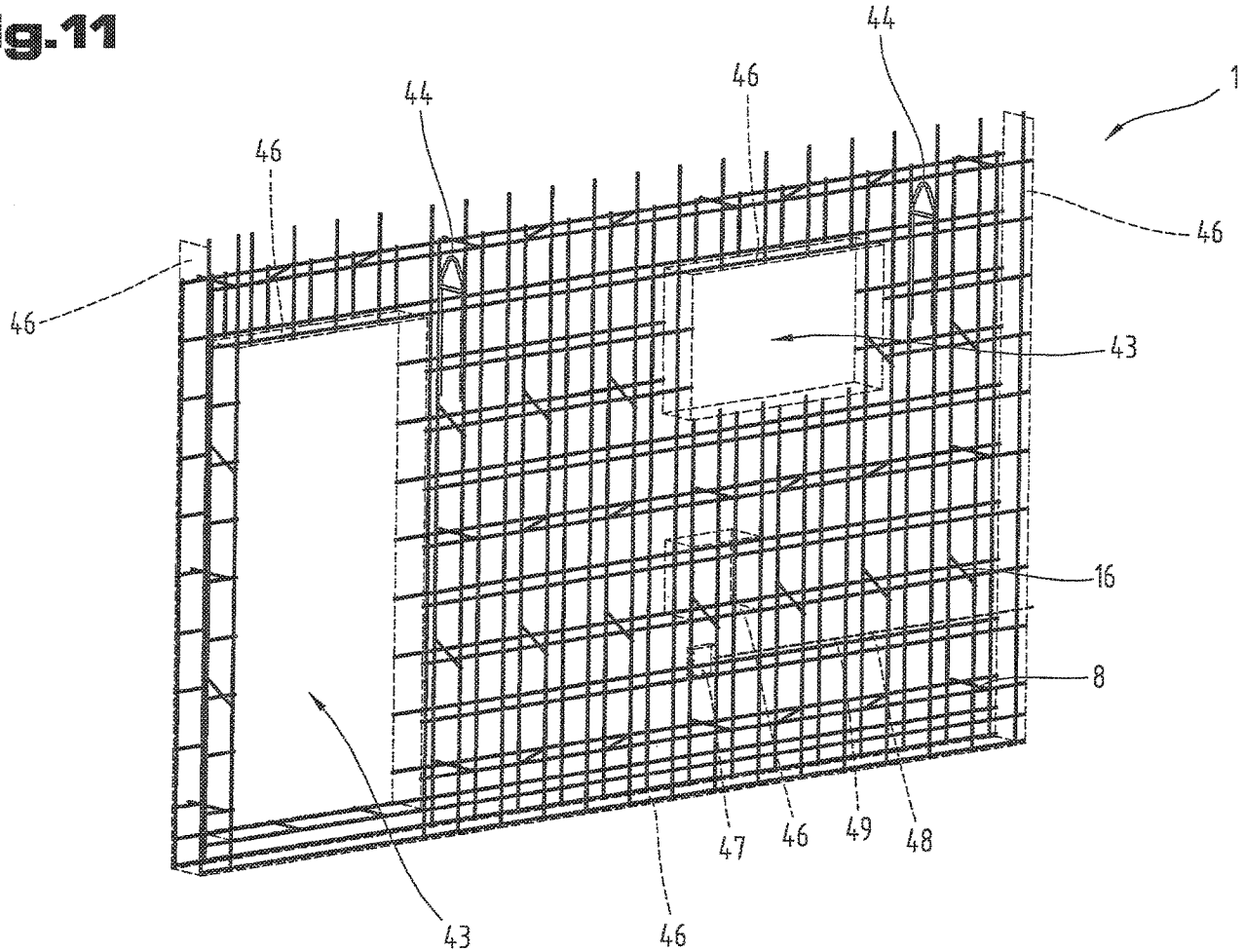
Figure 13:
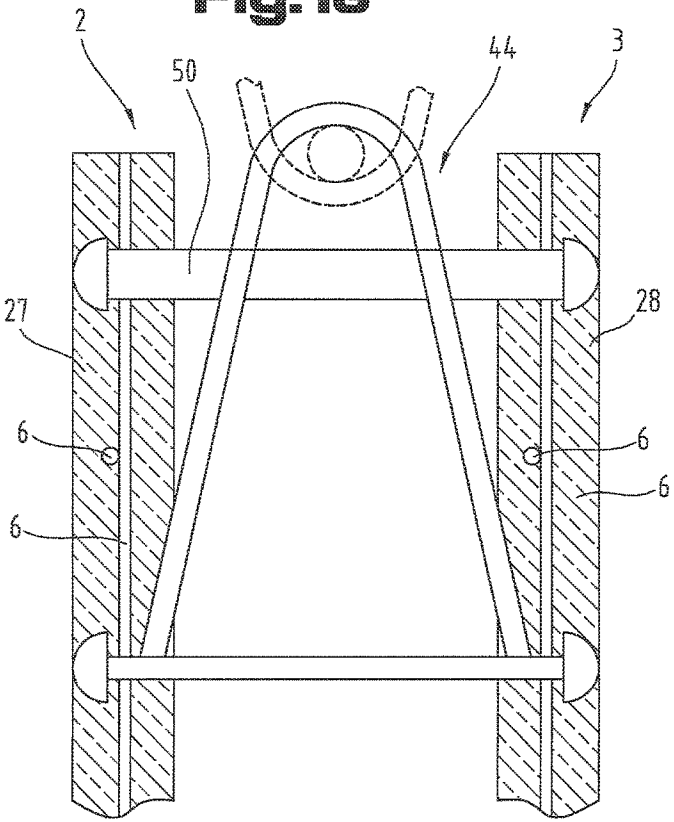
Figure 12:
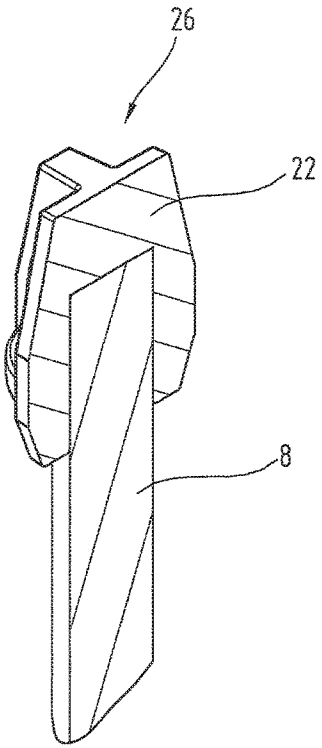
Figure 14:
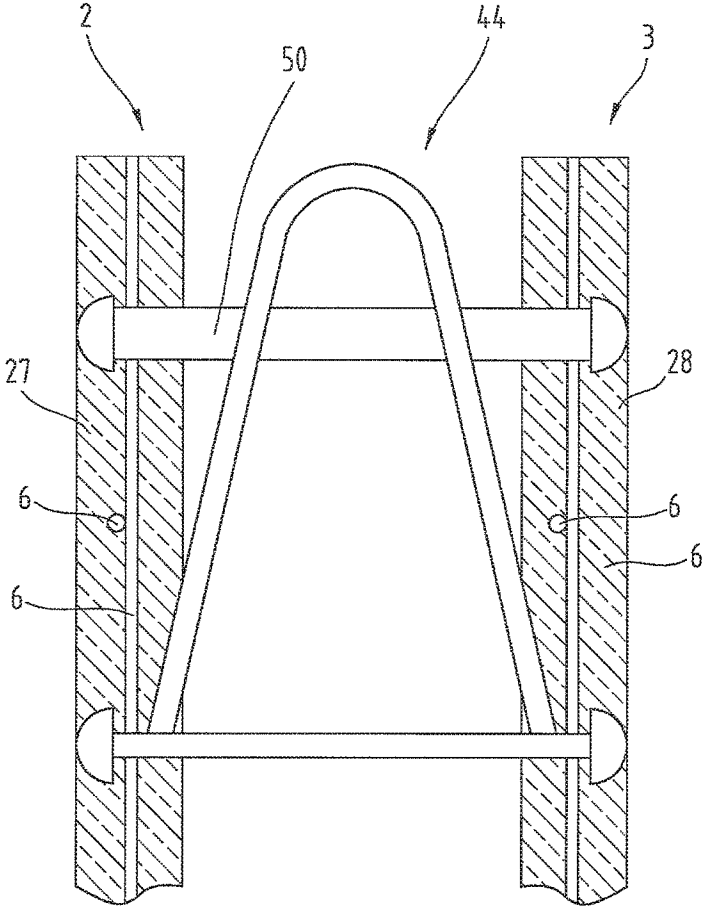

Extremely simplified, schematic depictions show the following:

FIG. 1 A perspective view of a reinforcing element;

FIG. 2 A top view of the reinforcing element from perspective II in FIG. 1;

FIG. 3 A side view of the reinforcing element from perspective III in FIG. 1;

FIG. 4 A side view from perspective III in FIG. 1 of another example embodiment of a reinforcing element;

FIG. 5 A detail of a spacer and a protective cap configured on it;

FIG. 6 A double wall furnished with the invented reinforcing element;

FIG. 7 A portrayal of a process step for producing a double wall, namely pouring the first wall shell;

FIG. 8 A portrayal of another process step for producing a double wall, namely preparation for producing the second wall shell;

FIG. 9 A perspective view of a complex reinforcing element for a double wall;

FIG. 10 A solid wall furnished with the invented reinforcing element;

FIG. 11 A perspective view of a complex reinforcing element for a double wall with formwork elements;

FIG. 12 A detail of another example embodiment of a spacer and a protective cap configured on it;

FIG. 13 Another example embodiment of a lifting frame in installed condition;

FIG. 14 Another example embodiment of a lifting frame in installed condition.

In introduction, let it be noted that in the variously described embodiments, identical parts are provided with identical reference signs or identical part names, and that the disclosures contained in the description as a whole can be carried over analogously to identical parts with identical reference signs or identical part names. Likewise, positional information selected in the description, e.g. above, below, on the side, etc. refer to the directly described and depicted figure and if the position is changed, this positional information carries over analogously to the new position.

FIG. 1 depicts an example of the invented reinforcing element 1 in a perspective view. FIG. 2 and FIG. 3 depict the reinforcing element 1 in a top view as in II from FIG. 1 and a side view as in III from FIG. 1, with the same reference signs and part names being used as in the preceding figures. To avoid unnecessary repetition, please refer to the detailed description in the above figures. To illustrate and clearly depict the invention, the reinforcing element 1 is only shown in an example section; the reinforcing element 1 may have larger dimensions than shown.

The invented reinforcing element 1 can be inserted in reinforced concrete construction as reinforcement or armouring. The reinforcing element 1 has a first reinforcing mat 2 and a second reinforcing mat 3, which each have a first mat plane 4 and a second mat plane 5. As is easier to see in FIG. 3, the two mat planes 4, 5 are each defined by the outermost points of the reinforcing mats 2, 3. It is an advantage if at least three spacers 8 are provided on a reinforcing element 1. This way the reinforcing element 1 can be well-supported on the spacers 8.

The reinforcing mats 2, 3 each have multiple mat rods 6 that are configured at angles to each other. This creates a grid shape where the mat rods 6 are welded to each other at junction points 7 where they overlap. The mat rods 6 are preferably made of rebar steel. A reinforcing mat 2, 3 is a grid structure of welded rods. The distance between the individual rods can be regular or irregular.

These reinforcing mats 2, 3 can be purchased as standardised prefabricated parts and cut to length as required on-site. In an alternative variation, it is also possible to cut the mat rods 6 to length and weld them together on-site during the manufacturing process of the reinforcing element 1.

As can be seen in FIG. 1, rod-shaped spacers 8 are provided that keep the individual reinforcing mats 2, 3 at a desired and predefined normal distance 9 from each other. The normal distance 9 is the distance at which the two mat planes 4, 5 of the reinforcing mats 2, 3 are placed from each other. The rod-shaped spacers 8, which are made of a metallic material, are connected to the mat rods 6 by a welding connection 10. The welding connection is preferably realised by resistance welding, especially by resistance spot welding. The advantage here is that this welding process is easily automated and that no additional material is needed for this welding process. However, as an alternative to resistance welding it is also possible for the spacers 8 to be connected to each other by e.g. a MAG welding process or laser welding.

It can be seen particularly well in FIG. 3, it can further be provided that the spacers 8 protrude beyond the first mat plane 4 in a direction 11 pointing away from the second reinforcing mat 3 by a first protrusion length 12. This characteristic makes it possible for the reinforcing mat 1 to be ideal for purposes where it is necessary for the first reinforcing mat 2 to be placed at a distance from a contact plane on which the reinforcing element 1 lies. This is the case in the production of double walls 13, ready-mix concrete parts, or prefabricated ceilings and the like. In addition, the invented reinforcing element 1 is also ideal to use for reinforcing parts in in-situ concrete. In other words, the protrusion length 12 can match the required concrete cover.

It can further be provided that mat rods 6 running in the longitudinal direction always be placed on a top side of the reinforcing element 1 and mat rods 6 running in the cross direction always be placed on the bottom side of the reinforcing element 1. In other words, that the first mat plane 4 and the second mat plane 5 are placed above one another with the same orientation. This execution is not depicted in the figures.

It can further be provided that the spacers 8 protrude beyond the second mat plane 5 in a direction 14 pointing away from the first reinforcing mat 2 by a second protrusion length 15. The advantages of this are analogous to those of the first protrusion length 12.

The desired concrete cover can be adjusted by varying the first protrusion length 12 and the second protrusion length 15. In other words, it is possible to adjust how far away the first reinforcing mat and the second reinforcing mat are placed from a concrete surface. Protrusion lengths 12, 15 are preferably chosen to be the same size so that the reinforcing element 1 or a double wall 13 furnished with it are symmetric. In an alternative variation or for special applications, it is however also possible for the protrusion lengths 12, 15 to be chosen to be different.

It can further be provided that in addition to the spacers 8, tie rods 16 also be placed on the reinforcing element 1 at an angle 17 to the spacers 8 or to a normal on the mat planes 4, 5. The tie rods 16 preferably reach between the first mat plane 4 and the second mat plane 5. In addition, the tie rods 16 are preferably placed in pairs forming a V-shape, which can give the reinforcing element 1 greater stiffness. In particular, this makes it possible to create greater resistance or greater solidity against parallel displacement of the two reinforcing mats 2, 3 from each other. The tie rods 16 can preferably have a smaller diameter than the spacers 8. It can further be provided that the tie rods 16 have the same diameter as the mat rods 6.

As seen in FIG. 2, it can further be provided that the spacers 8 and/or tie rods 16 be connected to the junction points 7 of the mat rods 6 at a distance 18 from these. This makes it possible to access the spacers 8 and/or tie rods 16 easily at their connection points with the mat rods 6. Automated processing by an industrial robot or a manufacturing system can be simplified. In addition, the distance 18 is preferably measured so that the tie rods 16 are placed as close as production allows to the junction points 7 of the mat rods 6, as the mat rods 6 have their greatest stiffness near the junction points 7. Furthermore, the spacers 8 and/or the tie rods 16 can have different diameters to e.g. be able to bear a variety of loads depending on need. In addition, the spacers and/or the tie rods 16 can be placed at an irregular distance to each other to be adjusted to the demands of the load.

It can further be provided that contact rods 19 be arranged near the second reinforcing mat 3 to define a support plane 20. These contact rods 19 can especially be of advantage in the production of the reinforcing element 1 because they can easily be connected to the spacers 8 or the tie rods 16, forming the support plane 20 on which the second reinforcing mat 3 can be placed in the manufacturing process. This makes it possible for the second reinforcing mat 3 to already be placed almost in its final position during the manufacturing process.

As can be seen in FIG. 3, it can be provided that the spacers 8 be placed on the first mat plane 4 or on the second mat plane 5 to stand normally on the reinforcing element 1.

FIG. 4 depicts another, potentially independent embodiment of the reinforcing element 1, where once again the same reference signs and part names are used for the same parts as have been used in the preceding FIGS. 1 to 3. To avoid unnecessary repetition, please refer to the detailed description in the above FIGS. 1 to 3. In FIG. 4, like in FIG. 3, a view as in III from FIG. 1 is selected.

In the example embodiment in FIG. 4, the rod-shaped spacers 8 are not placed standing normally on the mat planes 4, 5, but are placed at an angle to them. This makes it possible for the spacers 8 to take over the function of the tie rods 16 from FIG. 3, so the tie rods 16 are not needed in this example embodiment.

As can be seen in FIGS. 1 to 4, it can be provided that protective caps 22 be placed on at least one end section 21 of the spacers 8 which protect the spacers 8 against corrosion and act as a contact element during the manufacturing process.

FIG. 5 shows a section of a spacer 8 with a schematically depicted protective cap 22. As is shown in FIG. 5, the protective cap 22 has a receiving hole 23 in which the spacer 8 can be received. In the depiction in FIG. 5, the protective cap 22 is not fully fitted on the spacer 8 so that the interior of the protective cap 22 can be illustrated better. The protective cap 22 is preferably fitted on the spacer 8 up to the arrester. A diameter 24 of the receiving hole 23 is chosen to be equal to or smaller than a diameter 25 of the spacer 8. This makes it possible for the protective cap 22 to be fitted onto the spacer 8 when force is applied and to be firmly attached to it. This way the protective cap 22 cannot be shaken off accidentally during the manufacturing process. As seen in FIG. 5, it can further be provided that the protective cap 22 be configured to be tapering and/or rounded in an end section 26 facing away from the receiving hole 23. In particular, it can be provided that the protective cap 22 have a cone-like form at the end section 26. This makes it possible for the protective cap 22 to be as thin as possible at the end section 26 so that the protective cap 22 is not visible or only slightly visible on the surface of a double wall 13.

The protective cap 22 is preferably made of a plastic material. This can e.g. be a thermoplastic, which has high chemical stability and a high ageing resistance.

FIG. 6 shows a side view and a section of a double wall 13 that is furnished with the invented and already described reinforcing element 1. As is shown in FIG. 6, a first wall shell 27 is arranged near the first reinforcing mat 2 and a second wall shell 28 is arranged near the second reinforcing mat 3. In a double wall 13, there is an intermediate area 29 between the two wall shells 27, 28 that is filled with concrete after the double wall 13 is set up on side in order to obtain a solid concrete wall. In the ideal case, the wall shells 27, 28 have as low a wall thickness 30, 31 as possible so that the double wall 13 is as light as possible for transport. The limits of the minimum wall thickness 30, 31 of the wall shells 27, 28 are determined on the one hand by the minimum cover that the wall shells 27, 28 must have. This minimum cover is e.g. the distance from the external surface 32 of the first wall shell 27 to the first mat plane 4. The minimum cover can be adjusted by the positioning of the spacers 8 and is the same size as the first protrusion length 12. The same is true of the second wall shell 28, where the minimum cover is also calculated from the external surface 33 of the second wall shell 28. The wall thicknesses 30, 31 are further determined by a required minimum distance from an internal surface 34 of the first wall shell 27 to the first reinforcing mat 2 or from an internal surface 35 of the second wall shell 28 to the second reinforcing mat 3. The invented design of the reinforcing element 1 makes it possible for the wall thicknesses 30, 31 to be as low as possible. Because of the use of two reinforcing mats 2, 3 that have a stable connection in the form of the spacers 8, the risk that the reinforcing element 1 will be ripped out of one of the wall shells 27, 28 can be reduced.

FIG. 7 and FIG. 8 explain and illustrate the manufacturing process for producing a double wall 13 using schematic depictions, with identical reference signs and part names being used for the same parts as in the preceding figures. To avoid unnecessary repetition, please refer to the detailed description in the above figures.

In this document, the semi-finished product of the reinforcing element 1 or the double wall 13 is called part 36.

To manufacture the reinforcing element 1, the first reinforcing mat 2 is prepared in the first process step. The first reinforcing mat 2 can be a purchased part, but it is also possible for the first reinforcing mat 2 to be manufactured directly on site by welding mat rods 6.

The spacers 8 are also prepared by being cut to length and can already be equipped with the protective caps 22. Alternatively, it is possible for the protective caps to only be fitted onto the spacers 8 after completion of the reinforcing element 1.

After preparation of the first reinforcing mat 2, the rod-shaped spacers 8 are positioned compared to the mat rods 6 of the first reinforcing mat 2 such that the spacers 8 protrude beyond the mat rods 6 of the first reinforcing mat 2 by a first protrusion length 12. If the spacers 8 are positioned correctly, they can then be welded to the mat rods 6 of the first reinforcing mat 2.

In order to allow placement of the spacers 8 compared to the mat rods 6 of the reinforcing mat 2, it can be provided that the reinforcing mat 2 be placed on underlay blocks, creating the free space for the first protrusion length 12. It is also conceivable to place the first reinforcing mat 2 on a level surface with recesses during the manufacturing process, with the spacers 8 being inserted into these recesses and therefore arranged to be protruding compared to the first reinforcing mat 2. In yet another variation, it is also conceivable for the first reinforcing mat 2 to be held in position by the gripping system of a robot and for another robot to position and weld the spacers 8 relative to the first reinforcing mat 2.

It is further also conceivable that, in addition to the spacers 8, tie rods 16 also be positioned on and welded to the first reinforcing mat 2.

In a subsequent process step, the second reinforcing mat 3 is positioned at a normal distance 9 to the first reinforcing mat 2 and welded to the spacers 8. Here, too, it is possible for the second reinforcing mat 3 to be held in position by an industrial robot or another manufacturing system and then welded.

It is further also conceivable for the contact rods 19 to be positioned parallel to the first reinforcing mat 2 before the positioning of the second reinforcing mat 3 parallel to the first reinforcing mat 2 and to be welded to the spacers 8 or the tie rods 16 so that the support plane 20 is formed. The second reinforcing mat 3 can then be placed on this support plane 20, reducing or avoiding excessive deformation of the second reinforcing mat 2 during the manufacturing process.

These process steps create the three-dimensional reinforcing element 1 that acts as a basis for the further process steps for producing the double wall 13. The reinforcing element 1 can easily be transported or positioned within the manufacturing facility using a lifting crane in a manufacturing hall or in the manufacturing process for producing the double wall 13, making it possible for the reinforcing element 1 to be prefabricated independently of the actual production steps for producing the double wall 13. This can considerably simplify or rationalise the production process for producing the double wall 13.

As seen in FIG. 7, it can be provided that the welded and stable reinforcing element 1 be positioned on a formwork pallet 37, with the spacers 8, in particular their end sections 21, lying on a surface 38 of the formwork pallet 37.

Here, it is possible for the reinforcing element 1 to be placed on the formwork pallet 37 first and then for limiting formwork 39 to be positioned on the formwork pallet 37 to facilitate the concrete pouring process. Alternatively, it is conceivable for the limiting formwork 39 to be positioned on the formwork pallet 37 first and for the reinforcing element 1 to then be lifted into the formwork 37 in its entirety.

If the reinforcing element 1 is positioned as shown in FIG. 7, the actual concrete pouring process can be started. Here, a concrete preparation device 40 is used to apply a concrete layer 42 to the formwork pallet 37. It can be provided here that the concrete preparation device 40 be moved back and forth in a horizontal direction of motion 41 so that the concrete layer 42 is distributed evenly over the formwork pallet 37. In this process step, concrete is applied to the formwork pallet 37 until the desired wall thickness 30 of the first wall shell 27 is reached and the first reinforcing mat 2 is fully covered by the concrete layer 42.

In an alternative variation, it can also be provided that the concrete layer 42 be applied to the formwork pallet 37 prepared with limiting formwork 39 first and the reinforcing element 1 then be lifted onto the formwork pallet 37 so that the first reinforcing mat 2 dips into the prepared concrete layer 42.

To adequately compact the concrete layer 42, it can be provided that the formwork pallet 37 vibrate during the manufacturing process or that a vibrator be inserted into the concrete layer 42 in order to adequately compact and homogenise the concrete layer 42.

After this covering of the first reinforcing mat 2 with a concrete layer 42, the concrete layer 42 is left to harden and so forms the first wall shell 27. The hardening process can take place under surrounding environmental conditions, or it is also possible for the hardening process to be carried out in e.g. a hardening chamber at an elevated temperature. Once the first wall shell 27 is sufficiently hardened that it can be moved, the semi-finished part 36, in particular the reinforcing element 1 with the attached first wall shell 27, is lifted off the formwork pallet 37 and turned using a lifting device.

After the turning process, the position is as shown in FIG. 8. As seen in FIG. 8, after the part 36 is lifted off, the formwork pallet 37 is again covered with a concrete layer 42 to prepare the concrete for the second wall shell 28. After this filling process, the part 36 is dipped into the prepared concrete layer 42 and optionally solidified under vibration.

The concrete layer 42 is then hardened like the first wall shell 27 to create the second wall shell 28.

FIG. 9 depicts another, potentially independent embodiment of the reinforcing element 1, where once again the same reference signs and part names are used for the same parts as have been used in the preceding FIGS. 1 to 8. To avoid unnecessary repetition, please refer to the detailed description in the above FIGS. 1 to 8.

FIG. 9 shows a perspective view of a complex reinforcing element 1 as required for the double wall 13 of a house. As can be seen in FIG. 9, it can be provided that the reinforcing element 1 have recesses 43, e.g. for windows or doors.

Furthermore, as seen in FIG. 9, it is conceivable for the reinforcing element 1 to have lifting frames 44 by which the reinforcing element 1 and subsequently the finished double wall 13 can be positioned and moved using a lifting device.

FIG. 10 depicts another, potentially independent embodiment of the double wall 13, where once again the same reference signs and part names are used for the same parts as have been used in the preceding FIGS. 1 to 9. To avoid unnecessary repetition, please refer to the detailed description in the above FIGS. 1 to 9. As an alternative to use in a double wall 13 as shown in FIG. 6, it can be provided as shown in FIG. 10 that the invented reinforcing element 1 be used in a solid wall 45. In a solid wall 45, unlike in a double wall 13, there is no intermediate area 29; the reinforcing element 1 already has concrete poured completely over it in the prefabricated stage to create the solid wall 45, which can be moved or transported in its entirety.

FIG. 11 depicts another, potentially independent embodiment of the reinforcing element 1 of a double wall 13, where once again the same reference signs and part names are used for the same parts as have been used in the preceding FIGS. 1 to 10. To avoid unnecessary repetition, please refer to the detailed description in the above FIGS. 1 to 10.

FIG. 11 shows a perspective view of a complex reinforcing element 1 as required for the double wall 13 of a house. As can be seen in FIG. 13, it can be provided that the recesses 43 provided in the reinforcing element 1 for e.g. windows or doors be limited by one or more formwork elements 46. In another embodiment variation, it can be provided that one or more formwork elements 46 be used as an external stop end of the reinforcing element 1.

In yet another variation, it can be provided that the formwork elements 46 be placed in the middle of the reinforcing element 1 to form a cavity. The cavity can be used to save concrete when manufacturing the double wall 13, especially when pouring the double wall 13.

The formwork element 46 can, for example, consist of a metal strip. The metal strip can have a wall thickness between 0.5 mm and 15 mm, preferably between 1.5 mm and 3 mm. It can further be provided that the formwork element 46 be made of a contoured metal sheet, similar to corrugated sheet metal. This brings the advantage that a contoured sheet have greater stiffness for the same material thickness.

To affix the formwork element 46 to the reinforcing element 1, it can be provided that it be welded to the reinforcing mats 2, 3. It is conceivable for the formwork element 46 to be welded directly to one of the mat rods 6 of the reinforcing mats 2, 3. In particular, it can be provided that the formwork element 46 run parallel to one of the interior mat rods 6, touching it at a contact line and welded to it at individual points. It can further be provided that the formwork element 46 make a 90° angle where it touches the mat rods 6 and therefore forms a bracket. This angle can help brace the formwork element 46. In addition, this angle can create a stronger contact surface.

In another example embodiment, it can be provided that the formwork element 46 run at an angle of 90° to the internal mat rods 6 and only touch the individual mat rods 6 at individual points. It can also be provided that the formwork element 46 have recesses in the region of the crosswise running mat rods 6 into which the mat rods 6 can be slotted.

The formwork element 46 can give the reinforcing element 1 additional stiffness and stability.

It can further be seen in FIG. 11 that it can be provided that an electrical outlet place holder 47 or place holder for other installation parts be welded to one of the reinforcing mats 2, 3. The electrical outlet place holder 47 can create a cavity into which an electrical outlet, a light switch, or another electrical installation or other installation can be inserted after final completion of the double wall 13. The electrical outlet place holder 47 preferably has a square form and is also made of sheet metal so that it is easy to weld to one of the reinforcing mats 2, 3 or potentially also to the rod-shaped spacers 8 and/or the tie rods 16.

It can further be provided that a welding element be welded onto the reinforcing element 1, where an electrical outlet recess is fitted onto the welding element before concrete is poured onto the wall shell 27, 28 and the welding element therefore receives and positions the electrical outlet recess.

In addition, empty piping 48 can be provided through which the cable for an installation being inserted in the electrical outlet place holder 47 can be run. The empty piping 48 is preferably connected directly to an electrical outlet. The empty piping 48 is preferably held by holding clamps 49. The holding clamps 49 can also be welded to the reinforcing mats 2, 3.

FIG. 12 shows another example embodiment of the spacer 8 with protective cap 22. The protective cap 22 and the spacer 8 are shown in a half-section in this example embodiment. As this view shows, it can be provided that the end section 26 be shaped like a cross. It can further be provided that the protective cap 22 be cast directly onto the spacer 8 by injection moulding.

FIG. 13 shows another example embodiment of the lifting frame 44, with this being depicted as built into the wall shells 27, 28. As shown in FIG. 13, a crossbar 50 extending into the wall shells 27, 28 can be provided. This can direct the forces arising on the lifting frame 44 into the wall shells 27, 28. It can further be provided that the lifting frame 44 be welded to the reinforcing mats 2, 3 and/or the spacers 8 and/or the tie rods 16. It can alternately be provided that the lifting frame 44 only be inserted into the reinforcing element 1 during the manufacturing process. It can further be provided that the lifting frame 44 be designed so that the hook bracket extends partially beyond the wall shells 27, 28. Since the lifting frames 44 overlap, this allows a mirror double wall 13 to be connected to the depicted double wall 13 by a fastening bolt. It can further be provided that such elements, called locks, are only configured to secure together two double walls 13.

FIG. 14 shows another example embodiment of the lifting frame 44, with this being depicted as built into the wall shells 27, 28. As shown in FIG. 14, it can be provided that the frame extend beyond the crossbar 50. This makes it possible for the hook of the lifting device to be attached as far as possible from the edge of the wall shells 27, 28 and for the crossbar 50, which is designed to channel the forces in the wall shells 27, 28, to be placed as far as possible from the edge of the wall shells 27, 28 to prevent the lifting frame 44 from being ripped out as much as possible. Optionally, an additional crossbar can be configured.

The example embodiments show possible variations of the reinforcing element 1 and a double wall 13 furnished with it; let it be noted at this juncture that the invention is not limited to the specially portrayed variations of embodiments themselves, but that diverse combinations of the individual variations of embodiments are possible and that this possibility of variation falls within the competence of a person active in this technical field based on the teaching regarding technical action provided by this invention.

Furthermore, individual characteristics or combinations of characteristics from the depicted and described various example embodiments can constitute independent inventive or invented solutions.

The aim underlying the independent invented solutions can be taken from the description.

All information regarding ranges of values in this description should be understood to mean that these include any and all partial ranges, e.g. the statement 1 to 10 should be understood to mean that all partial ranges starting from the lower threshold 1 and the upper threshold 10 are included, i.e. all partial ranges begin with a lower threshold of 1 or larger and with an upper threshold of 10 or less, e.g. 1 to 1.7 or 3.2 to 8.1 or 5.5 to 10.

Above all, the individual embodiments shown in FIGS. 1 to 3, 4, 5, 6, 7 to 8, 9, 10, 11, 12, 13 can form the subject of independent invented solutions. The relevant aims according to the invention and solutions can be found in the detailed descriptions of these figures.

As a matter of form, let it be noted that, to facilitate a better understanding of the design of the reinforcing element 1 and a double wall 13 furnished with it, these and their components have in places been portrayed not to scale and/or enlarged and/or scaled-down.

LIST OF REFERENCE SIGNS

1 Reinforcing element
2 First reinforcing mat
3 Second reinforcing mat

4 First mat plane
5 Second mat plane
6 Mat rod
7 Junction point
8 Rod-shaped spacer
9 Mat planes normal distance
10 Welding connection
11 Direction pointing away from the second reinforcing mat
12 First protrusion length
13 Double wall
14 Direction pointing away from the first reinforcing mat
15 Second protrusion length
16 Tie rod
17 Angle
18 Distance
19 Contact rod
20 Support plane
21 Spacer end section
22 Protective cap
23 Protective cap receiving hole
24 Receiving hole diameter
25 Spacer diameter
26 Protective cap end section
27 First wall shell
28 Second wall shell
29 Intermediate area
30 First wall shell thickness
31 Second wall shell thickness
32 First wall shell external surface
33 Second wall shell external surface
34 First wall shell internal surface
35 Second wall shell internal surface
36 Part
37 Formwork pallet
38 Formwork pallet surface
39 Limiting formwork
40 Concrete preparation device
41 Horizontal direction of motion
42 Concrete layer
43 Recess
44 Lifting frame
45 Solid wall
46 Formwork element
47 Electrical outlet place holder
48 Empty piping
49 Holding clamps
50 Crossbar

The invention claimed is:

1. A method with the following process steps:

providing a first reinforcing mat with metal mat rods welded at angles to one another in junction points and a second reinforcing mat with metal mat rods welded at angles to one another in junction points;

positioning rod-shaped spacers across from the mat rods of the first reinforcing mat;

welding the spacers to the mat rods of the first reinforcing mat;

positioning the second reinforcing mat at a normal distance from the first reinforcing mat, with the second reinforcing mat being positioned in such a way that the spacers extend between the first reinforcing mat and the second reinforcing mat wherein the first reinforcing mat, the second reinforcing mat and the rod-shaped spacers are positioned such that a cavity is provided between the first reinforcing mat and the second reinforcing mat, wherein the cavity serves for filling with concrete at a construction site in an end manufacturing of the double wall;

welding the spacers to the mat rods of the second reinforcing mat to provide a three-dimensional reinforcing element to be used for a double wall construction; and subsequently executing the following process steps after preparation of the three-dimensional reinforcing element:

providing a horizontally oriented formwork pallet; and positioning the reinforcing element on the horizontally oriented formwork pallet so that the first and second reinforcement mats extend horizontally and the spacers contact the horizontally oriented formwork pallet for correct positioning of the first and second reinforcing mats within the concrete;

wherein the spacers are positioned compared to the mat rods of the first reinforcing mat such that the spacers protrude beyond the mat rods of the first reinforcing mat by a first protrusion length; and wherein the second reinforcing mat is positioned such that the spacers protrude beyond the mat rods of the second reinforcing mat by a second protrusion length.

2. The method as in claim 1, wherein the rod-shaped spacers are cut to length before positioning and are furnished with protective caps on at least one end section, the protective caps being disposed between the spacers and the horizontally oriented formwork pallet when the reinforcing element is positioned on the horizontally oriented formwork pallet.

3. The method as in claim 1, wherein tie rods running at an angle to the spacers are welded to the mat rods of the first and second reinforcing mats.

4. The method as in claim 3, wherein contact rods running parallel to the first reinforcing mat are positioned and welded to the spacers, the tie rods, or both the spacers and the tie rods before positioning the second reinforcing mat.

5. The method as in claim 1, further comprising the following process steps:

mounting limiting formwork on the formwork pallet;

supplementing the limiting formwork on the formwork pallet;

applying a layer of concrete onto the formwork pallet, with vibration of the formwork pallet or concrete layer as necessary until the first reinforcing mat is fully covered; and storing the part until hardening or solidification of the concrete layer into a first wall shell.

6. The method as in claim 5, wherein the following process steps are executed after production of the first wall shell:

removing the reinforcing element with the attached first wall shell from the formwork pallet;

turning the reinforcing element with the attached first wall shell;

providing a second horizontally oriented formwork pallet and mounting of limiting formwork on the second formwork pallet;

applying a second concrete layer onto the second formwork pallet;

dipping the second reinforcing mat of the reinforcing element into the second concrete layer, with vibration of the formwork pallet until the second reinforcing mat is fully covered by concrete;

storing the part until hardening or solidification of the second concrete layer into a second wall shell.

7. The method as in claim 1, further comprising storing in a hardening chamber until solidification or hardening of a concrete layer into a first wall shell.

* * * * *